US007028971B2

(12) United States Patent
Scott

(10) Patent No.: US 7,028,971 B2
(45) Date of Patent: Apr. 18, 2006

(54) KEYBOARD ARM

(75) Inventor: Timothy P. Scott, Waterloo (CA)

(73) Assignee: Ergostream Products Inc., Waterloo (CA)

( * ) Notice: Subject to any disclaimer, the term of this patent is extended or adjusted under 35 U.S.C. 154(b) by 2 days.

(21) Appl. No.: 10/824,414

(22) Filed: Apr. 15, 2004

(65) Prior Publication Data

US 2004/0238705 A1 Dec. 2, 2004

Related U.S. Application Data

(60) Provisional application No. 60/463,341, filed on Apr. 17, 2003.

(51) Int. Cl.
*A47F 5/00* (2006.01)

(52) U.S. Cl. ..... 248/918; 248/118.1; 248/118.3; 248/346.01; 108/69; 108/75

(58) Field of Classification Search ..... 248/918, 248/118.1, 118.3, 346.01, 274.1, 276.1, 281.11; 108/69, 75

See application file for complete search history.

(56) References Cited

U.S. PATENT DOCUMENTS

| | | | | |
|---|---|---|---|---|
| 4,616,798 | A * | 10/1986 | Smeenge et al. | 248/281.11 |
| 4,706,919 | A * | 11/1987 | Soberalski et al. | 248/281.11 |
| 5,704,299 | A * | 1/1998 | Corpuz et al. | 108/50.01 |
| 5,765,797 | A * | 6/1998 | Greene et al. | 248/398 |
| 5,791,263 | A * | 8/1998 | Watt et al. | 108/138 |
| 6,098,935 | A * | 8/2000 | Kaplan et al. | 248/118.1 |
| 6,279,859 | B1 * | 8/2001 | West et al. | 248/118 |
| 6,343,775 | B1 * | 2/2002 | Jones et al. | 248/284.1 |
| 6,397,763 | B1 * | 6/2002 | Panzarella et al. | 108/138 |
| 6,726,168 | B1 * | 4/2004 | Barber | 248/284.1 |

* cited by examiner

*Primary Examiner*—Robert P. Olszewski
*Assistant Examiner*—Steven Marsh
(74) *Attorney, Agent, or Firm*—Daryl W. Schnurr

(57) ABSTRACT

An articulating arm is infinitely adjustable within a predetermined range. A pivot arm has arcuate surfaces extending therefrom with a brake pivotally mounted to intersect a path of rotation of the arcuate surfaces. Two heat treated shoes provide the arcuate surfaces. The brake is a plate that is controlled to lock or unlock the pivot member relative to a bracket to which the pivot member is pivotally connected. A support is pivotally connected to the pivot member at an end opposite of the bracket. The brake is unlocked manually by forcing the support upward when the support is in a locked position relative to the pivot member.

20 Claims, 10 Drawing Sheets

KEYBOARD ARM

This application claims the benefit of Provisional Application No. 60/463,341 filed Apr. 17, 2003.

BACKGROUND OF THE INVENTION

1. Field of Invention

This invention relates to an articulating arm and, more particularly, to an articulating arm for keyboards and the like that is infinitely adjustable within a pre-determined range.

2. Description of the Prior Art

Articulating arms, that are adjustable within a predetermined range, are known. These arms are usually mounted under a work surface and are often used to support a keyboard or other device in a position that is most comfortable to a particular user. Previous keyboard support arms are adjustable to various specific positions. Previous arms display infinite height adjustability but with locking limitations which can affect platform stability and performance. Limitations to the height locking mechanisms of previous arms are related to the instability and inadequacy of the design of the locking mechanism which causes slippage or complete "height-lock" failure when moderate force is applied in the body pivot region at the connection point to the keyboard support platform.

SUMMARY OF THE INVENTION

It is an object of the present invention to provide an articulating arm for keyboards and the like where the arm can be unlocked from a locked position, moved to any number of new positions on an infinite basis within a pre-determined range and locked into the new position. It is a further object of the present invention to provide an articulating arm where the arm can be locked in position without downward slippage and can be easily unlocked despite force being applied to the arm when the arm is in a locked position.

An articulating arm for keyboards and the like is used with a base. The arm comprises a bracket, pivot member and support, the bracket being pivotally mounted to a first end of the pivot member at a first pivot point. The support is pivotally mounted to a second end of the pivot member at a second pivot point. The pivot member has an arcuate surface extending therefrom near the first pivot point. The first pivot point has a first locked and unlocked position, said first locked and unlocked position being controlled by a brake that is adjustably mounted to move into an out of locking contact with the arcuate surface. The second pivot point has a second locked and unlocked position. The bracket is connected to the base.

An articulating arm for keyboards and the like has a bracket, pivot member and support. The bracket is pivotally mounted to a first end of the pivot member at a first pivot point. The support is pivotally mounted to a second end of the pivot arm at a second pivot point. The pivot member has an arcuate surface extending therefrom near the first pivot point. A brake is adjustably mounted to move between a locked position when contact between the brake and the arcuate surface prevents movement of the arcuate surface relative to said brake, and an unlocked position when the arcuate surface is movable relative to the brake in both directions. The supporting surface has a locked position and an unlocked position relative to the pivot arm.

Preferably, the brake is adjustably mounted at a third pivot point and the brake has a smaller radius of rotation about the third pivot point in an extended position than a radius of rotation of the arcuate surface about the first pivot point, the path of the arcuate surface intersecting with the path of the brake when the brake is in the extended and locked position, the path of the brake corresponding to the path of the arcuate surface within a predetermined range when the brake is in the unextended and unlocked position. The brake is biased to the locked position by a spring.

Preferably, the articulating arm is locked and unlocked by a cable or by the adjustment of an angle of the supporting surface to the pivot arm.

DESCRIPTION OF A PREFERRED EMBODIMENT

Figure 1:
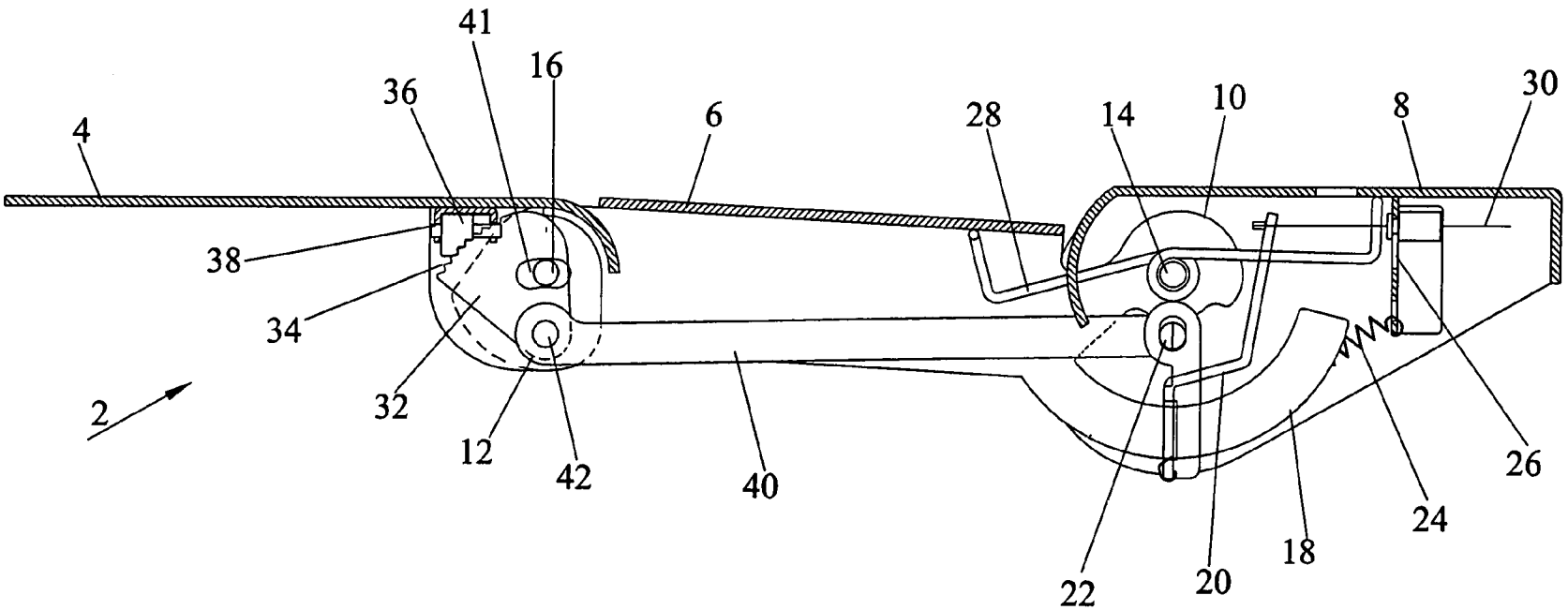
FIG. 1 is a partial sectional side view of an articulating arm.

In FIG. 1, an articulating arm 2 has a support 4, a pivot member 6 and a bracket 8. The pivot member 6 has two ends 10, 12, being a first end 10 and a second end 12. The bracket 8 is pivotally mounted to the first end 10 of the pivot member 6 at a first pivot point 14. The support 4 is pivotally mounted to the second end 12 of the pivot member 6 at a second pivot point 16. The pivot m ember 6 has an arcuate surface 18 extending therefrom at the first end 10 near the first pivot point 14. A brake 20 is adjustably mounted at a third pivot point 22. A spring 24 biases the brake 20 toward a brace 26. A spring 28 extends between the bracket 8 and the pivot member 6 to assist in the upward movement of the pivot member 6 relative to the bracket 8 when the pivot member 6 and bracket 8 are in an unlocked position relative to one another. A cable 30 controls the movement of the brake 20. The cable forces an unlocked portion of the brake 20 toward the brace 26, thereby moving a lower portion of the brake 20 away from the brace 26 to an unlocked position. When the cable is released, the spring 24 pulls the brace 20 to the locked position, the brake 26 is in contact with arcuate surface 18 to prevent downward movement of the pivot member 6 relative to the bracket 8.

At the second end 12, a locking plate 32 has a saw tooth edge 34, a lock slide 36 is located within a tilt housing 38. The tilt housing has a cable (not shown in FIG. 1) connected to the lock slide 36 to move the lock slide into and out of contact with the saw tooth edge 34. When the lock slide 36 is out of contact with the saw tooth edge 34, the support 4 can pivot relative to the pivot member 6 about the second pivot point 16. When the lock slide 36 is in contact with the saw tooth edge 34, the support 4 is locked into position relative to the pivot member 6. Since the saw tooth edge 34 has specific incremental saw teeth, the adjustment between the support 4 and the pivot member 6 is not infinite within the pre-determined range as the lock slide 36 will only slide between the saw teeth and the incremental adjustments are therefore controlled by the size of the adjacent teeth.

A link member 40 extends between the third pivot point 22 and a fourth pivot point 42 on the lock plate 32. The purpose of the link member 40 is to maintain the angle of the support 4 constant relative to the angle of the bracket 8 when the pivot member 6 is pivoted with respect to the bracket 8. For example, if the support 4 is horizontal and the pivot member 6 is adjusted upward relative to the bracket 8, while the lock slide 36 remains in a locked position, the support 4 will remain horizontal and will therefore automatically pivot relative to the pivot member 6 while the pivot member 6 is adjusted relative to the bracket 8. The link 40 member causes the lock plate 32 to pivot about the second pivot point 16 as the pivot member 6 is raised or lowered. A slot 41 in the lock plate 32 allows the lock plate 32 to rotate relative to the second pivot point 16.

Figure 2:
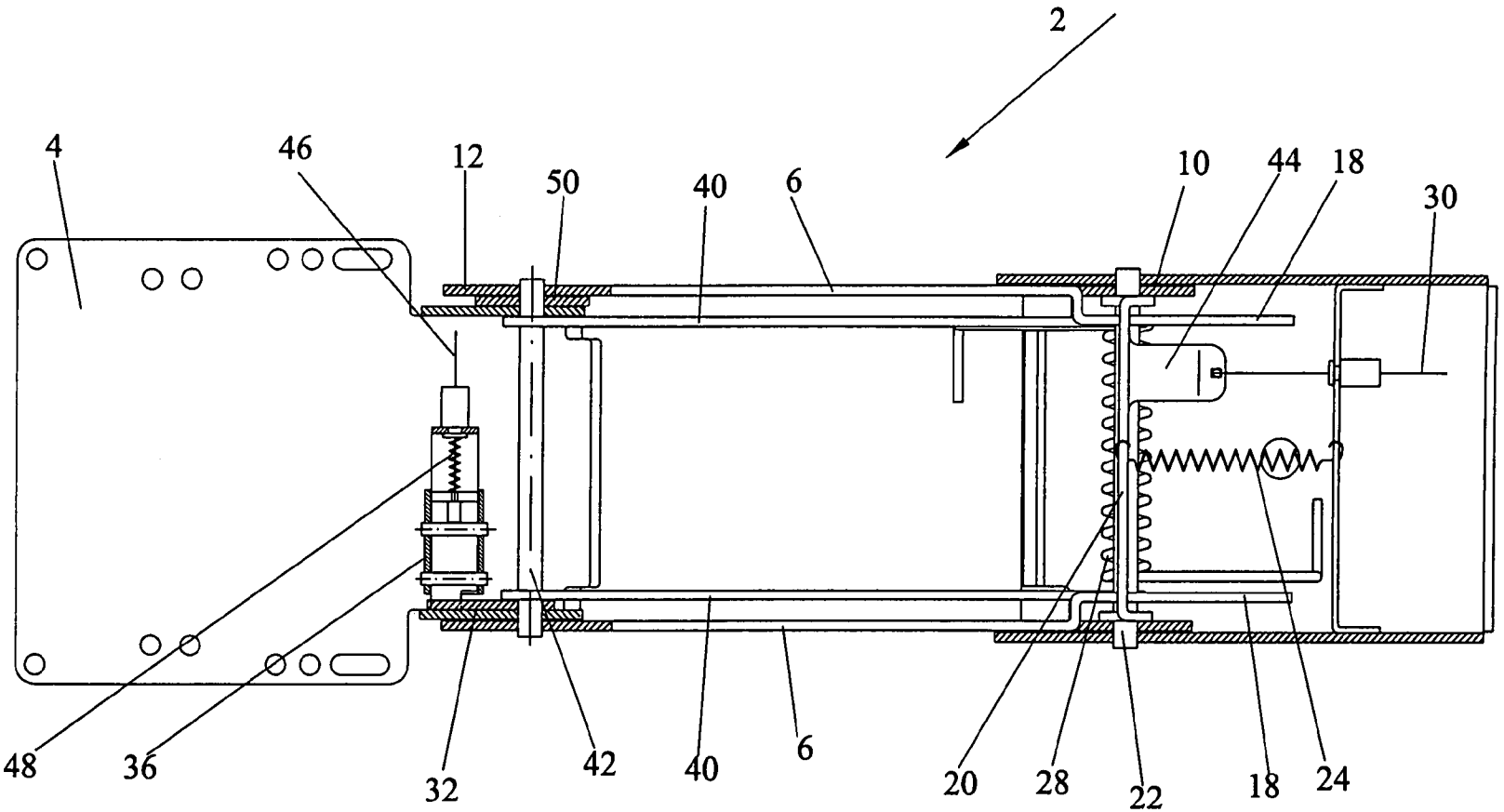
FIG. 2 is a bottom view of the articulating arm of FIG. 1.

In FIG. 2, there is shown a bottom view of the articulating arm 2 and the width of the various components described in FIG. 1 are shown. The same reference numerals are used in FIG. 2 to refer to the same components as shown in FIG. 1 without further explanation unless otherwise indicated. It can be seen that the brake 20 has a tab 44 thereon and it is the tab 44 that is connected to the cable 30. It can be seen that there are two arcuate surfaces and that the brake 20 can contact both arcuate surface s simultaneously. It can also be seen that there are two link members 40 and that there is a cable 46 connected to control the lock slide 36. A lock spring 48 biases the lock slide 36 to a locked position and the cable overcomes the strength of the lock spring 48 to move the lock slide 36 to an unlocked position.

There is a spacer 50 around the second pivot point 16 on a side of the pivot member 6 opposite to the locking plate 32. The two arcuate surfaces 18, one on either side of the articulating support arm 2, provide a seat for the brake 20. When the pivot member is in a locked position, the pivot member 6 can still be moved upward but cannot be moved downward relative to the bracket 8.

While the locked and unlocked position of the pivot member 6 relative to the bracket 8 as shown in FIGS. 1, 2, 3 and 4 is controlled by the cable 30, other means can be used to move the brake 20 from a locked to an unlocked position. Similarly, the cable 46 on the lock slide 36 can be replaced by other locking or unlocking means. For example, the manual tilting of the support 4 can move the articulating support arm between a locked and an unlocked position.

Figure 3:
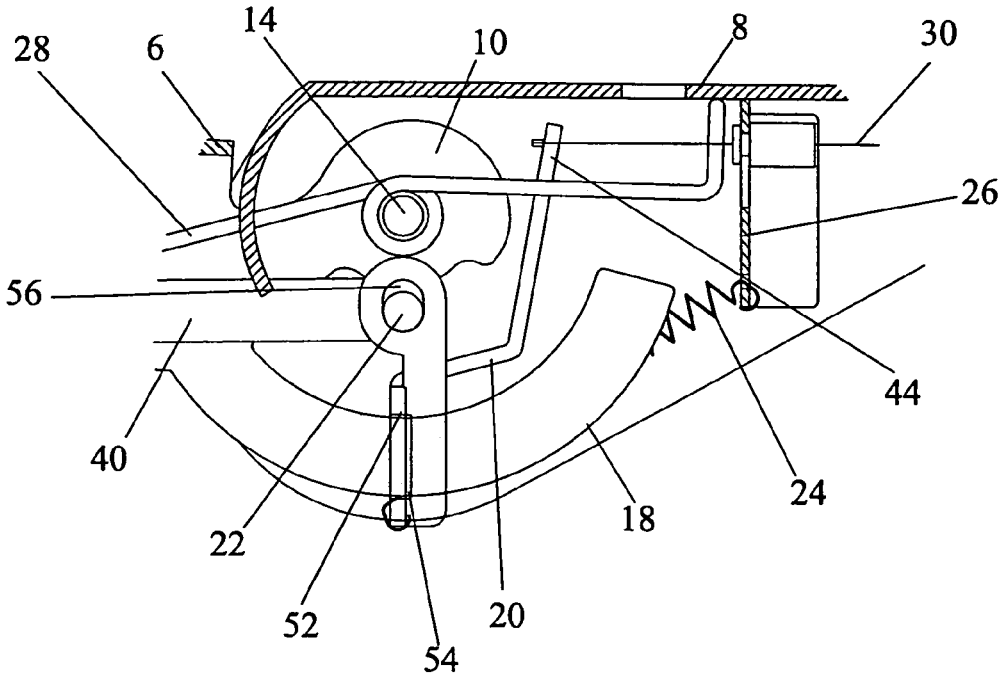
FIG. 3 is an enlarged side view of part of the articulating arm with a pivot arm and bracket in an unlocked position.
Figure 4:
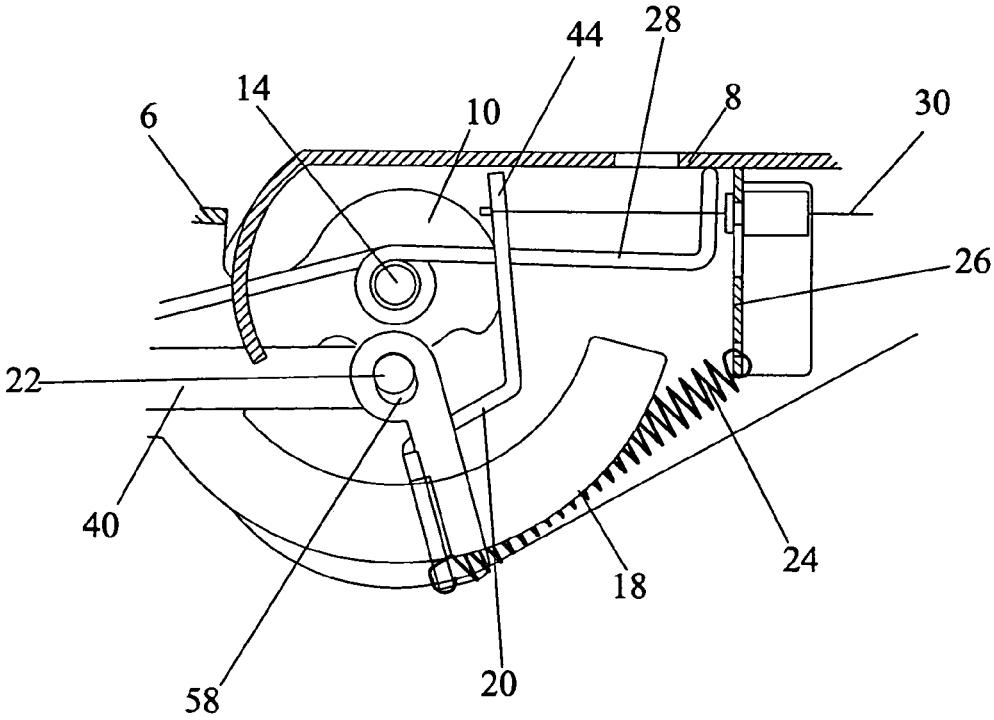
FIG. 4 is a partial side view of the articulating arm when the pivot arm and bracket are in locked position.

In FIGS. 3 and 4, there is shown an enlarged partial side view of a locking mechanism between the bracket 8 and the pivot member 6. The same reference numerals are used in FIGS. 3 and 4 as those used in FIGS. 1 and 2 for those components that are identical. FIG. 3 shows the pivot member 6 and bracket 8 in an unlocked position and FIG. 4 shows the pivot member 6 and bracket 8 in a locked position. In FIG. 3, the cable 30 pulls the tab 44 towards the brace 26, thereby causing the brake 20 to pivot clockwise (when viewed from the position shown in FIGS. 1, 3 and 4). In this position, it should be noted that there is a slight gap between upper and lower edges 52, 54 respectively of the brake 20. Also, in this position, which is the unlocked position, the arcuate surface 18 is allowed to rotate freely, within a pre-determined range either clockwise or counterclockwise about the first pivot point 14. In FIG. 3, the brake is in an unextended (and unlocked) position as there is a gap 56 on an upper side of the third pivot point 22. Thus, the pivot member 6, is readily adjustable relative to the bracket 8. As stated previously, (although not shown in FIGS. 3 and 4) even though the lock slide 36 remains in a locked position on the lock plate, the support 4 will still rotate relative to the pivot arm 6 as the support 4 will maintain the same angle relative to the bracket 8 throughout the rotation of the pivot member 6 about the first pivot point 14. The first pivot point 14 has a first locked and unlocked position and the second pivot point 16 has a second locked and unlocked position. The first pivot point 14 has an infinite number of locking locations within a pre-determined range and within said first locked position.

In FIG. 4, the cable 30 forces the tab 44 further away from the bracket 26, which causes the brake 20 to rotate counterclockwise (because of the force exerted by the spring 24) about the fourth pivot point 22. In this position, the arcuate surface 18 is prevented third further counterclockwise rotation about the first pivot point 14. In other words, further downward movement of the pivot member 6 relative to the bracket 8 is prevented by the brake 20 and the brake is in a locked position. It can be seen from FIG. 4 that the brake 20 is in an extended position on the third pivot point 22. In FIG. 4, in the extended (and locked) position of the brake 20 relative to the third pivot point 22, there is a gap 58 on the lower side of the pivot point 22. In the locked position shown in FIG. 4, the upward or clockwise rotation of the pivot member 6 about the bracket 8 is not prevented as an upward force on the pivot member 6 will tend to move the brake 20 toward the unlocked position. However, the support arm will lock again as soon as a downward force is placed on the support arm. Since the member 6 and support 4 as well as a keyboard or other component or peripheral (not shown) on the support 4 places a downward force on the pivot arm 6, the upward rotation of the pivot member 6 when the pivot member 6 and bracket 8 are in the locked position shown in FIG. 4 will not present a practical problem to a user of the invention.

Figure 5:
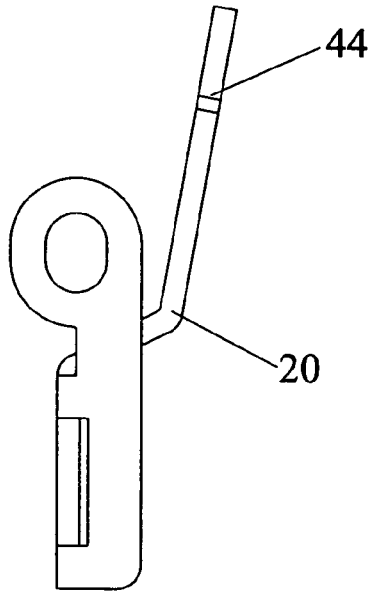
FIG. 5 is a side view of a brake.
Figure 6:
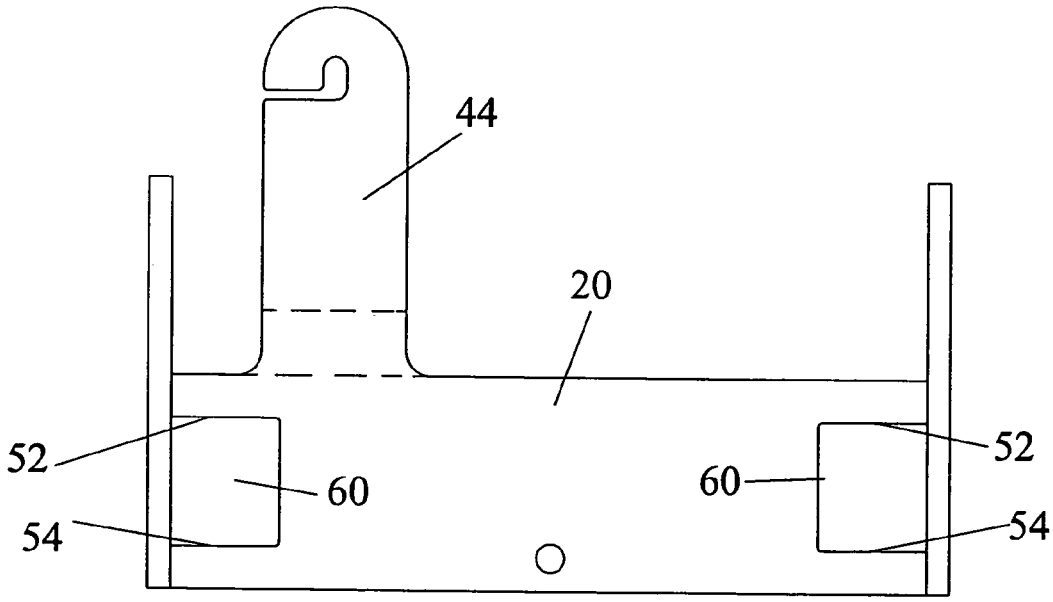
FIG. 6 is a front view of the brake of FIG. 5.

In FIGS. 5 and 6, there is shown a side and front view respectively of the brake 20 including the tab 44. The brake 20 has the upper edge 52 and the lower edge 54 of an opening 60, which surrounds the two arcuate surfaces 18 (not shown in FIG. 5). The brake 20 is a plate containing one opening 60 on each side of the brake 20.

The path of rotation defined by the arcuate surface 18 has a larger radius than the path of rotation defined by the brake 20 when the brake is in a locked position. The third pivot point 22 is located closer to the arcuate surface 18 than is the first pivot point 14. The shorter radius for the brake 20 results in the path of rotation of the brake 20 intersecting with the path of rotation of the arcuate surface 18. There are two points of intersection, one towards the brace 26, which is at the locked position shown in FIG. 4 and one in the opposite direction towards the support 4. The point of intersection towards the support 4 is not utilized by the embodiment of the present invention shown in the drawings. It can be seen that FIG. 4 shows that the locked position is approximately 15 degrees from vertical.

In FIG. 3, in the unlocked position, the brake 20 is in a vertical position. The unlocked position would be a range of positions and would not be restricted to the vertical position shown in FIG. 3. When the brake is in the unextended and unlocked position, there are no points of intersection between the brake 20 and the arcuate surface 18 within the pre-determined range. Similarly, the locked position shown in FIG. 4 could be more or less than 15 degrees from vertical, depending on the design of the articulating support arm 2.

Figure 7:
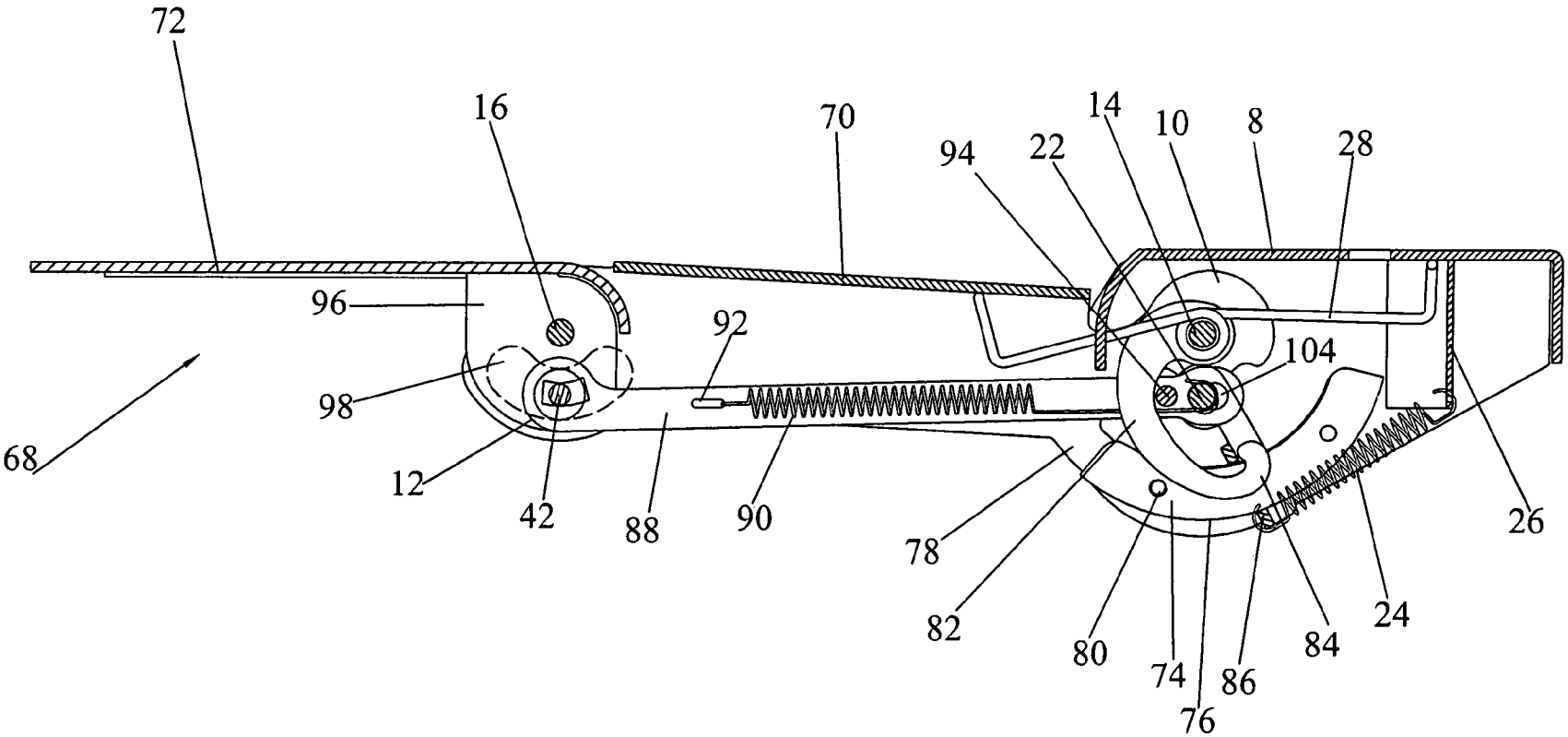
FIG. 7 is a partial sectional side view of a further embodiment of an articulating arm having a pivot member and bracket in a locked position.
Figure 8:
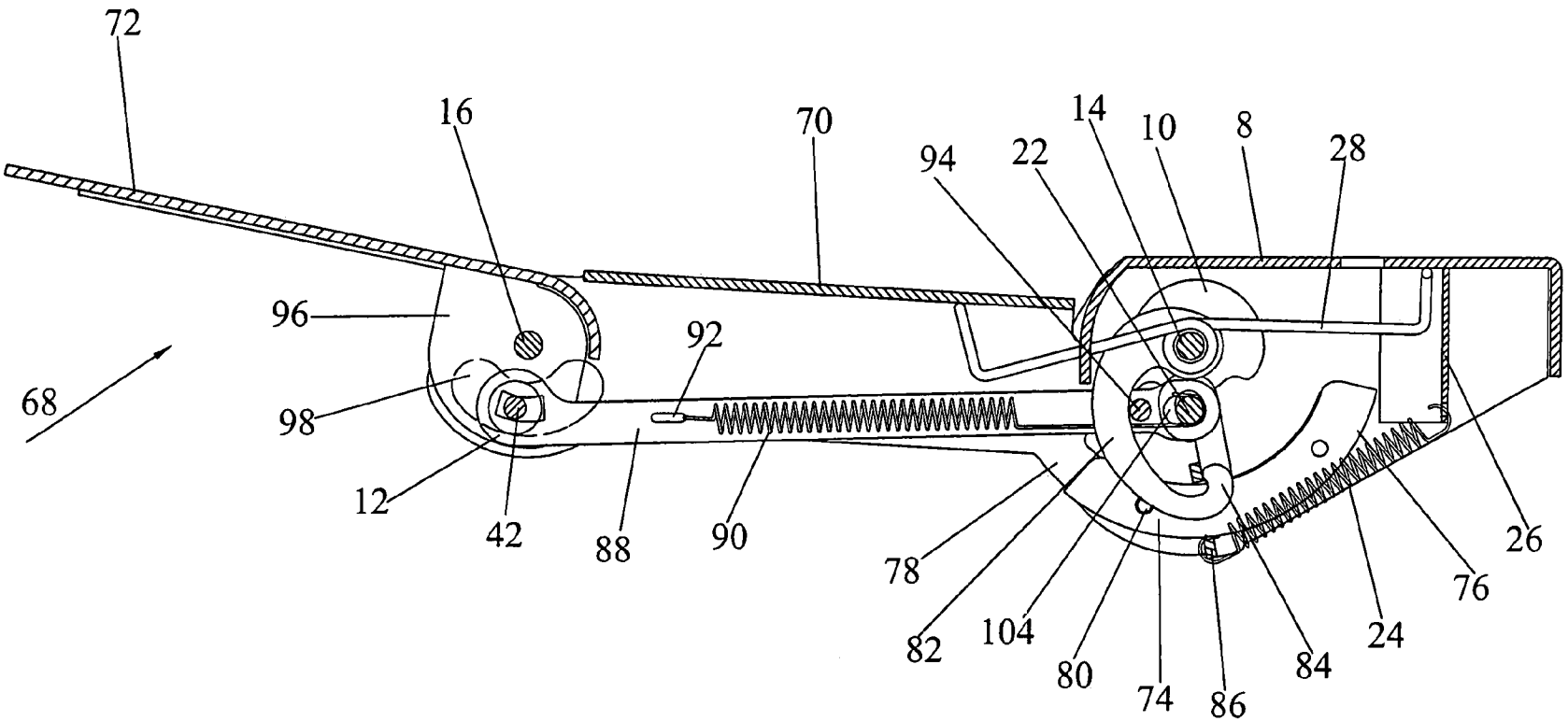
FIG. 8 is a partial sectional side view of the articulating arm of FIG. 7 where the pivot member and bracket in an unlocked position.
Figure 9:
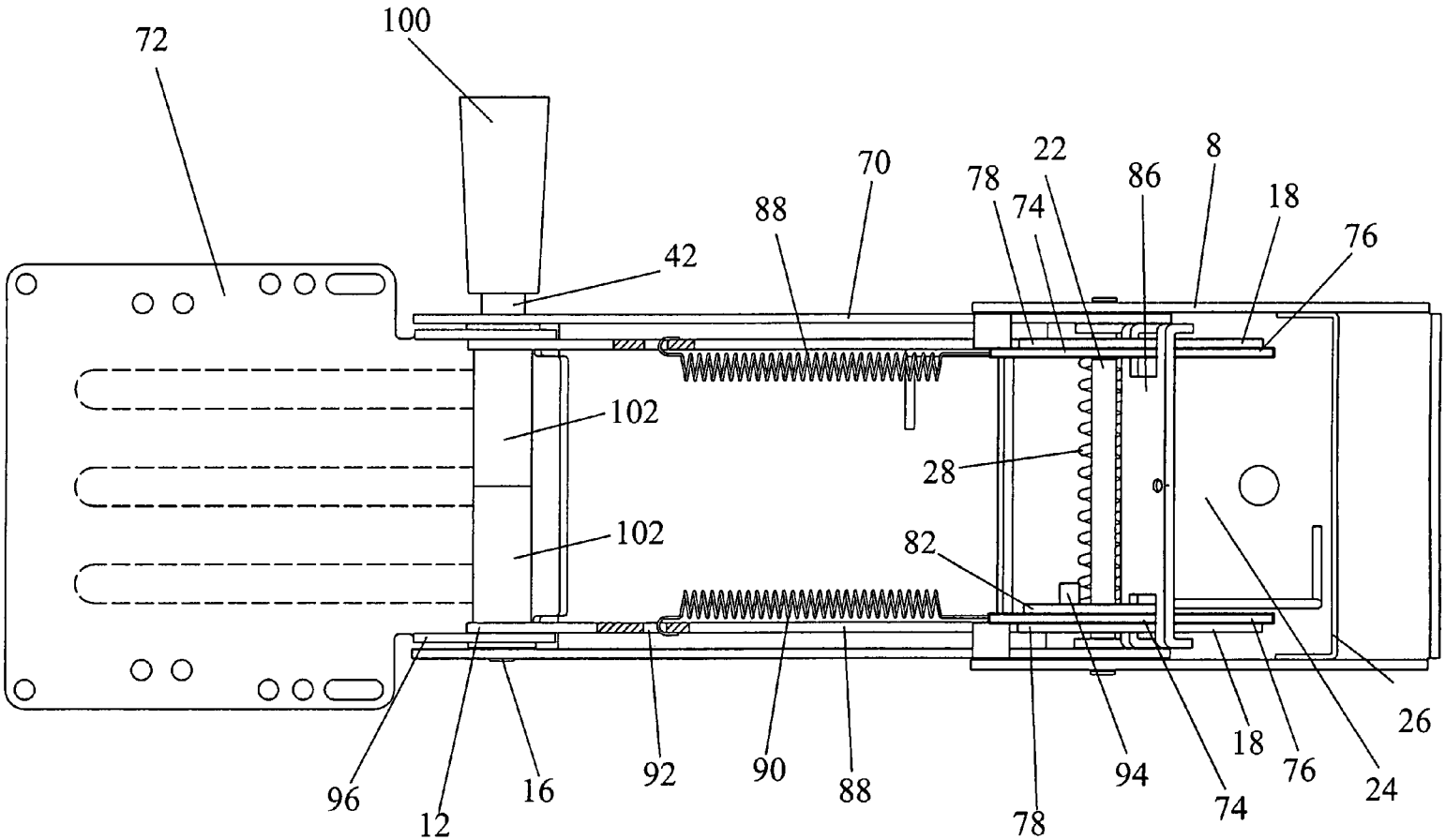
FIG. 9 is a bottom view of the articulating arm of FIG. 7.

In FIGS. 7, 8 and 9 there is shown two side views and a bottom view of a further embodiment an articulating arm 68, the bracket 8, a pivot member 70 and a support 72. The pivot member 70 has two ends 10, 12, being the first end 10 and the second end 12. The bracket 8 is pivotally mounted to the first end 10 of the pivot member 70 at the first pivot point 14. The support 72 is pivotally mounted to the second end 12 of the pivot member 70 at the second pivot point 16. A shoe 74, having arcuate surface 76, is affixed to an extension 78 by bolts 80. A C-shaped member 82 is pivotally mounted about the first pivot point 14 and has a free end 84. The free end 84 contacts a brake 86 that is adjustably mounted about the third pivot point 22. The spring 24 biases the brake 86 toward the brace 26. The pivot member is in a locked position relative to the bracket in FIG. 7, and in an unlocked position in FIG. 8.

A link member 88 extends between the third pivot point 22 and the fourth pivot point 42. A spring 90 is connected between the third pivot point 22 and an opening 92 in the link member 88. A projection 94 extends outward from the link member 88 adjacent to the C-shaped member 82. A side plate 96 is affixed to the support 72 and enables the support 72 to pivot about the second pivot point 16. A channel 98 is located in a side (not shown in FIGS. 7 and 8) of the pivot member 70. When a handle 100 on the pivot point 42 is turned in the appropriate direction, the support 72 is free to pivot about the second pivot point 16 relative to the pivot member 70. There are two sleeves 102 mounted on the pivot point 42. The turning of the handle to the locked position locks the two sleeves against one another. When the handle 100 is moved to the unlocked position, the two sleeves are released and the support 72 can pivot relative to the pivot member 70.

Figure 10:
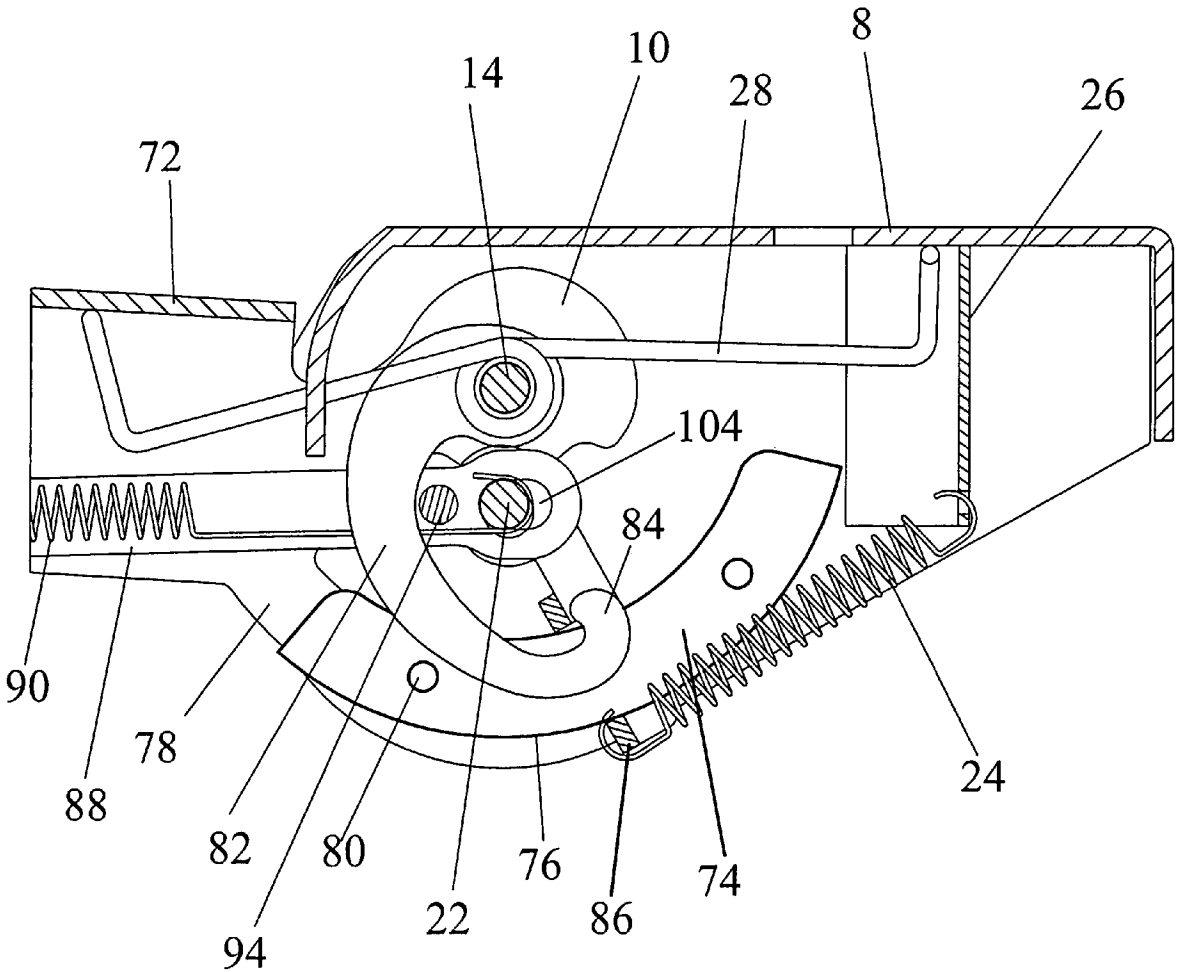
FIG. 10 is a partial sectional enlarged side view of the articulating arm in the locked position shown in FIG. 7.
Figure 11:
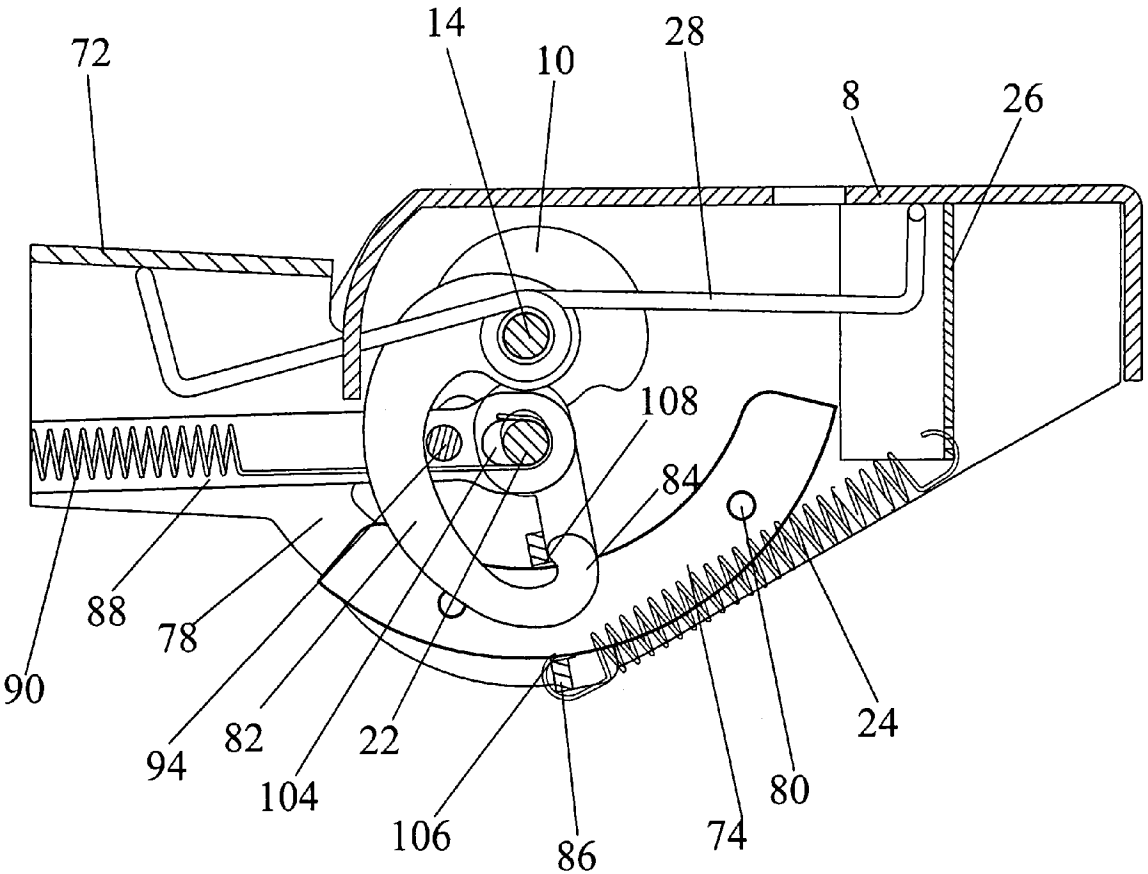
FIG. 11 is a partial sectional side view of the articulating arm in the unlocked position shown in FIG. 8.

From FIG. 9, it can be seen that there are two link members 88 and two springs 90 as well as two shoes 74, two curved surfaces 76 and two extensions 78. The extensions 78 are preferably curved to be aligned with the curved surface 76 of the shoes 74. By referring to FIGS. 10 and 11, which are partial enlarged versions of the bracket ends of FIGS. 7 and 8 respectively, the locking and unlocking of the pivot member 72 relative to the bracket 8 can be more easily understood. In FIG. 10, the pivot member 72 is in the locked position relative to the bracket 8 and in FIG. 11, the pivot member 72 is in the unlocked position relative to the bracket 8. In FIG. 11, it can be seen that in the unlocked position, there is a gap between the shoes 74 and a lower surface 106 of an opening in the brake 86 and an upper surface 108 of the opening in the brake 86. The gap allows the shoe 74 and therefore the pivot member 72 to rotate freely about the first pivot point 14 relative to the brake 86. In FIG. 10, the brake 86 is in a locked position relative to the shoe 74 and prevents the pivot member 72 from moving downward or counter-clockwise about the pivot point 14 relative to the bracket 8 when viewed from the position shown in FIGS. 7, 8, 10 and 11. The same reference numerals are used in FIGS. 7 to 11 as those used in FIG. 1 to 4 to refer to those components that are identical to the components of FIGS. 7 to 11.

The arm 68 operates in a manner that is very similar to the arm 2 shown in FIGS. 1 to 4. The arm 2 is moved between a locked position and an unlocked position by cables. The arm 68 has a support that is locked and unlocked relative to the pivot member by turning a locking handle. The pivot member and bracket are moved from the locked position to the unlocked position by manually applying an upward tilting force to the support when the support is locked in position relative to the pivot member by the handle. The pivot member and bracket of the arm 68 are moved from the unlocked position to the locked position by removing the manual tilting force from the support when the arm has been moved to the desired position.

Figure 12:
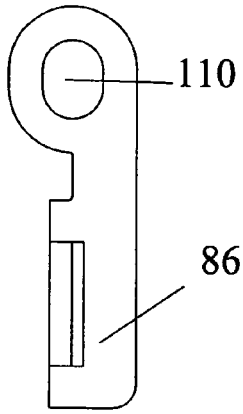
FIG. 12 is a side view of a brake.
Figure 13:
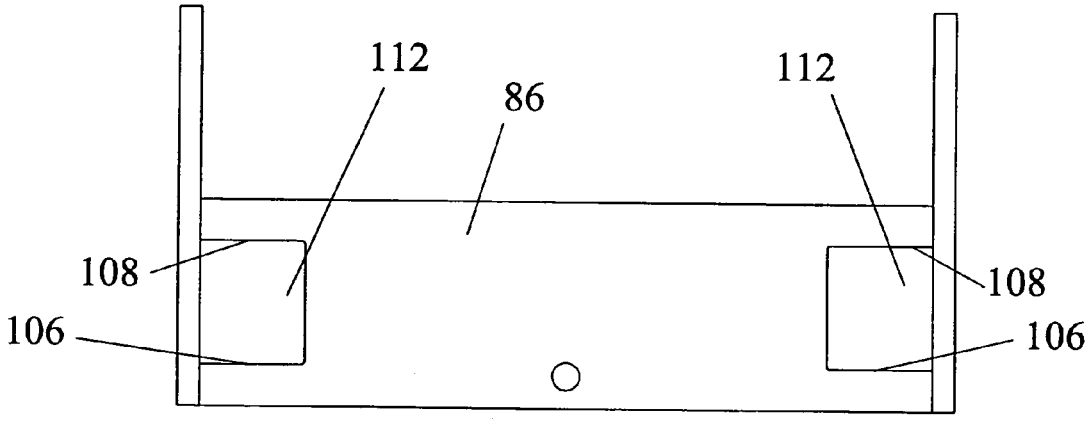
FIG. 13 is a front view of the brake of FIG. 12.

In FIGS. 12 and 13, there is shown a side view and front view respectively of the brake 86. It can be seen that the brake 86 has an elongated opening 110. The brake 86 fits over the third pivot point 22 (not shown in FIGS. 12 and 13) through the elongated opening 110. The elongated shape of the opening 110 allows the brake 86 to pivot about the third pivot point 22.in two different paths of rotation. In the unlocked position, the brake 86 is in an unextended position relative to the third pivot point 22 and the path of rotation conforms with the path of rotation of the shoe 74. In the locked position, the brake 86 is in an extended position on the third pivot point 22 and has a path of rotation that intersects with the rotation of the shoe 74 at two points. As with the arms 2, only the point of intersection near the brace 26 (not shown in FIGS. 12 and 13) is utilized to lock the bracket and pivot member. The intersection of the two paths of rotation causes the brake 86 to lock onto the shoe 74 to prevent further movement of the shoe 74 in a counter-clockwise direction about the first pivot point 14. The brake 86 operates with respect to the elongated opening 110 in a similar manner to the brake 20 shown in FIGS. 1–6. In FIG. 13, it can be seen that the brake 86 has two openings 112 on either side thereof. The openings 112 are sized to receive the two shoes 74 (not shown in FIG. 13). The openings 112 each have an upper surface 108 and a lower surface 106.

When the handle 100 is turned to the locked position, the support 72 is no longer able to pivot about the second pivot point 16 relative to the pivot member 70. However, with the support 72 and handle 100 in the locked position, the support 72 is still able to be manually pivoted slightly in a clockwise direction about the pivot point 16 as shown by comparing the position of the support 72 in FIGS. 7 and 8. In FIG. 8, it can be seen that the support 72 is tilted upward slightly. When the support 72 is in the locked position, the upward or clockwise movement of the support 72 pulls the fourth pivot point 42 further away from the third pivot point 22, thereby closing a gap 104 on the (side of the pivot point 22) as shown in FIG. 7 and creating a gap 104 on the support side of the third pivot point 22 (as shown in FIG. 8). In other words, the link member 88 moves longitudinally toward the support 72, thereby causing the projection 94 to move against the C-shaped member 82. The force of the projection 94 causes the C-shaped member to pivot clockwise in the view shown in FIGS. 7 and 8 about the first pivot point 14. The free end 84 of the C-shaped member 82 causes the brake 86 to rotate in a clockwise direction (in the views shown in FIGS. 7 and 8) about the third pivot point 22. This causes the brake 86 to move against the force of the spring 24 from the locked position shown in FIG. 7 to the unlocked position shown in FIG. 8. In other words, a manually applied upward rotational force on the support 72 when the support 72 is in a locked position releases the pivot member 70 relative to the bracket 8 and allows the pivot member 70 to rotate clockwise or counter-clockwise relative to the bracket 8 about the first pivot point 14. When the manual force is removed from the support 72, the pivot member and the bracket 8 will return to the locked position because of the bias of the spring 24 and the spring 90. The link member 88 will return to the position shown in FIG. 7.

The present invention has advantages in that, in one embodiment, only the brake 20 need be heat treated. In another embodiment, which is a preferred embodiment, only the shoes and the brake need be heat treated. If the shoes become worn or defective, they can be easily and inexpensively removed and replaced with new shoes. The pivot member 6 can be locked relative to bracket 8 in an infinite number of positions within a pre-determined range. In the unlocked and unextended position of the brake (for example, shown in FIGS. 8 and 11) there are still points of intersection between the brake and the curved surfaces, but the points of intersection are outside the predetermined range.

I claim:

1. An articulating arm for keyboards for use with a base, said arm comprising a bracket, pivot member and support, said bracket being pivotally mounted to a first end of said pivot member at a first pivot point, said support being pivotally mounted to a second end of said pivot member at a second pivot point, said pivot member having an arcuate surface extending therefrom near said first pivot point, said first pivot point having a first locked and unlocked position, said first locked and unlocked position being controlled by a brake that is adjustably mounted to move into and out of locking contact with said arcuate surface, said second pivot point having a second locked and unlocked position, said bracket being connected to said base.

2. An articulating arm as claimed in claim 1 wherein said first pivot point has an infinite number of locking locations along said arcuate surface within a pre-determined range, said locking locations being used with said first locked position.

3. An articulating arm as claimed in claim 2 wherein said arcuate surface is a shoe attached to said pivot member.

4. An articulating arm as claimed in claim 3 wherein said shoe is heat tempered.

5. An articulating arm as claimed in claim 1 wherein said brake is a plate that is heat tempered.

6. An articulating arm as claimed in any one of claims 1,2 or 5 wherein said brake is a plate and said plate has a third pivot point, said plated having an unextended position and an extended position relative to said third pivot point, said plate being in said unextended position when said brake is in a locked position relative to said arcuate surface and an extended position when said brake is in an unlocked position relative to said arcuate surface.

7. An articulating arm as claimed in claim 5 wherein said plate is adjustably mounted at a third pivot point and there is a link member extending between said third pivot point and a fourth pivot point, said link member being constructed to oriented said support relative to said pivot member as said pivot member is oriented relative to said base.

8. An articulating arm as claimed in claim 1 wherein said support is constructed relative to said pivot member so that said support can be locked in position relative to said pivot member and can be in an unlocked position wherein said support can pivot relative to said pivot member and relative to said base.

9. An articulating arm as claimed in any one of claims 1,2 or 7 wherein there is a second arcuate surface and a second link member on said pivot member, said arcuate surfaces simultaneously interacting with said brake.

10. An articulating arm as claimed in claim 1 wherein said support is constructed relative to said pivot member so when said support is in a locked position relative to said pivot member, said pivot member and said bracket can be moved from a locked position to an unlocked position by manually tilting said support upward relative to said pivot member.

11. An articulating arm as claimed in claim 1 wherein said first locked and unlocked position is controlled by one of a first cable and by tilting the support upward.

12. An articulating arm as claimed in claim 1 wherein said second locked and unlocked position is controlled by one of a second cable and a locking handle.

13. An articulating arm as claimed in claim 1 wherein said brake has a spring connected thereto to bias said brake to a locked position.

14. An articulating arm as claimed in claim 10 wherein said pivot member and said bracket can be moved from an unlocked position to a locked position by manually releasing said support while said support is in a locked position relative to said pivot member.

15. An articulating arm as claimed in any one of claims 1, 2 or 8 wherein said arcuate surface is mounted at a constant radius from said first pivot point, said constant radius being maintained as said arcuate surface pivots about said first pivot paint.

16. An articulating arm for keyboards for use with a base comprising a bracket, pivot member and support, said bracket being pivotally mounted to a first end of said pivot member at a first pivot point, said support being pivotally mounted to a second end of the pivot arm at a second pivot point, said pivot member having an arcuate surface extending there from near said first pivot point, a brake being adjustably mounted to move between a locked position in which contact between said brake and said arcuate surface prevents movement of said arcuate surface relative to the brake, and an unlocked position when said arcuate surface is movable relative to said brake in both directions, said support having a locked position and an unlocked position relative to said pivot arm.

17. An articulating arm as claimed in claim 16 wherein said brake is adjustably mounted at a third pivot point, said brake having a smaller radius of rotation about said third pivot point in an extended position than a radius of rotation of said arcuate surface about said first pivot point, a path of said arcuate surface intersecting with the path of said brake when the brake is in said extended position, said path of said situate surface generally corresponding to a path of said brake when said brake is in an unextended position.

18. An articulating arm as claimed in claim 17 wherein said brake is in said locked position when said brake is extended and said brake is in said unlocked position when said brake is unextended.

19. An articulating arm as claimed in claim 16 wherein said brake is biased to said locked position by a spring.

20. An articulating arm as claimed in claim 19 wherein said arm is moved from a locked position to an unlocked position by a cable, said cable being connected to move said brake from the unextended position to the extended position.

* * * * *